US011145471B2

(12) United States Patent
Hartung et al.

(10) Patent No.: US 11,145,471 B2
(45) Date of Patent: Oct. 12, 2021

(54) ARRANGEMENT AND METHOD FOR DRIVING A MOVABLE CONTACT OF A VACUUM INTERRUPTER IN A HIGH-VOLTAGE CIRCUIT BREAKER

(71) Applicant: SIEMENS AKTIENGESELLSCHAFT, Munich (DE)

(72) Inventors: Alexander Hartung, Berlin (DE); Michael Bartz, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/772,936

(22) PCT Filed: Nov. 15, 2018

(86) PCT No.: PCT/EP2018/081317
§ 371 (c)(1),
(2) Date: Jun. 15, 2020

(87) PCT Pub. No.: WO2019/115132
PCT Pub. Date: Jun. 20, 2019

(65) Prior Publication Data

US 2020/0365343 A1 Nov. 19, 2020

(30) Foreign Application Priority Data

Dec. 15, 2017 (DE) ..... 102017222943

(51) Int. Cl.
*H01H 3/42* (2006.01)
*H01H 3/46* (2006.01)
(Continued)

(52) U.S. Cl.
CPC ..... *H01H 3/46* (2013.01); *H01H 3/42* (2013.01); *H01H 33/664* (2013.01); *H01H 33/666* (2013.01); *H01H 2033/6667* (2013.01)

(58) Field of Classification Search
CPC .. H01H 3/46; H01H 3/42; H01H 3/32; H01H 3/54; H01H 33/664; H01H 33/666;
(Continued)

(56) References Cited

U.S. PATENT DOCUMENTS 4,227,059 A * 10/1980 Ogawa ..... H01H 33/666 200/248
4,516,004 A 5/1985 Bany et al.
(Continued)

FOREIGN PATENT DOCUMENTS

DE 102016205011 A1 9/2017
EP 0102317 A2 3/1984
(Continued)

*Primary Examiner* — William A Bolton
(74) *Attorney, Agent, or Firm* — Laurence A. Greenberg; Werner H. Stemer; Ralph E. Locher

(57) ABSTRACT

In an arrangement and a method for driving a movable contact of a vacuum interrupter in a high-voltage circuit breaker, an actuating rod forms an element of a kinematic chain of the high-voltage circuit breaker. A lever element can rotate about an axis and can be mechanically connected to a drive via a connection element. A coupling element is configured to mechanically movably couple the actuating rod and the lever element. The actuating rod and the coupling element each have a longitudinal axis. The longitudinal axes are situated substantially on a common axis at a point in time when a separating action of the vacuum interrupter occurs.

17 Claims, 1 Drawing Sheet

(51) Int. Cl.
*H01H 33/664* (2006.01)
*H01H 33/666* (2006.01)

(58) Field of Classification Search
CPC ..... H01H 33/6664; H01H 2033/6667; H01H 33/022; H01H 2033/024; H01H 2033/66246; H01H 2033/66253
USPC ..... 200/335, 336, 337; 218/120, 140, 153, 218/154, 118
See application file for complete search history.

(56) References Cited

U.S. PATENT DOCUMENTS 4,996,397 A * 2/1991 Kuhn ..... H01H 3/3042 200/568
5,191,180 A * 3/1993 Kitamura ..... H01H 33/666 218/135
6,917,006 B2 * 7/2005 Bachofen ..... H01H 3/3052 200/318.2
6,927,355 B2 * 8/2005 Thuresson ..... H01H 33/36 218/154
7,563,161 B2 * 7/2009 Perret ..... H01H 33/143 218/140
7,650,816 B2 * 1/2010 Chyla ..... F16D 1/12 74/559
8,592,708 B2 * 11/2013 Hatanaka ..... H02B 13/0655 218/153
2010/0078300 A1 * 4/2010 Freundt ..... H01H 3/30 200/337
2013/0057083 A1 3/2013 Donzel et al.

FOREIGN PATENT DOCUMENTS

EP 1523024 A1 4/2005
WO WO2004049365 A1 6/2004
WO WO2005/024877 A1 3/2005

* cited by examiner

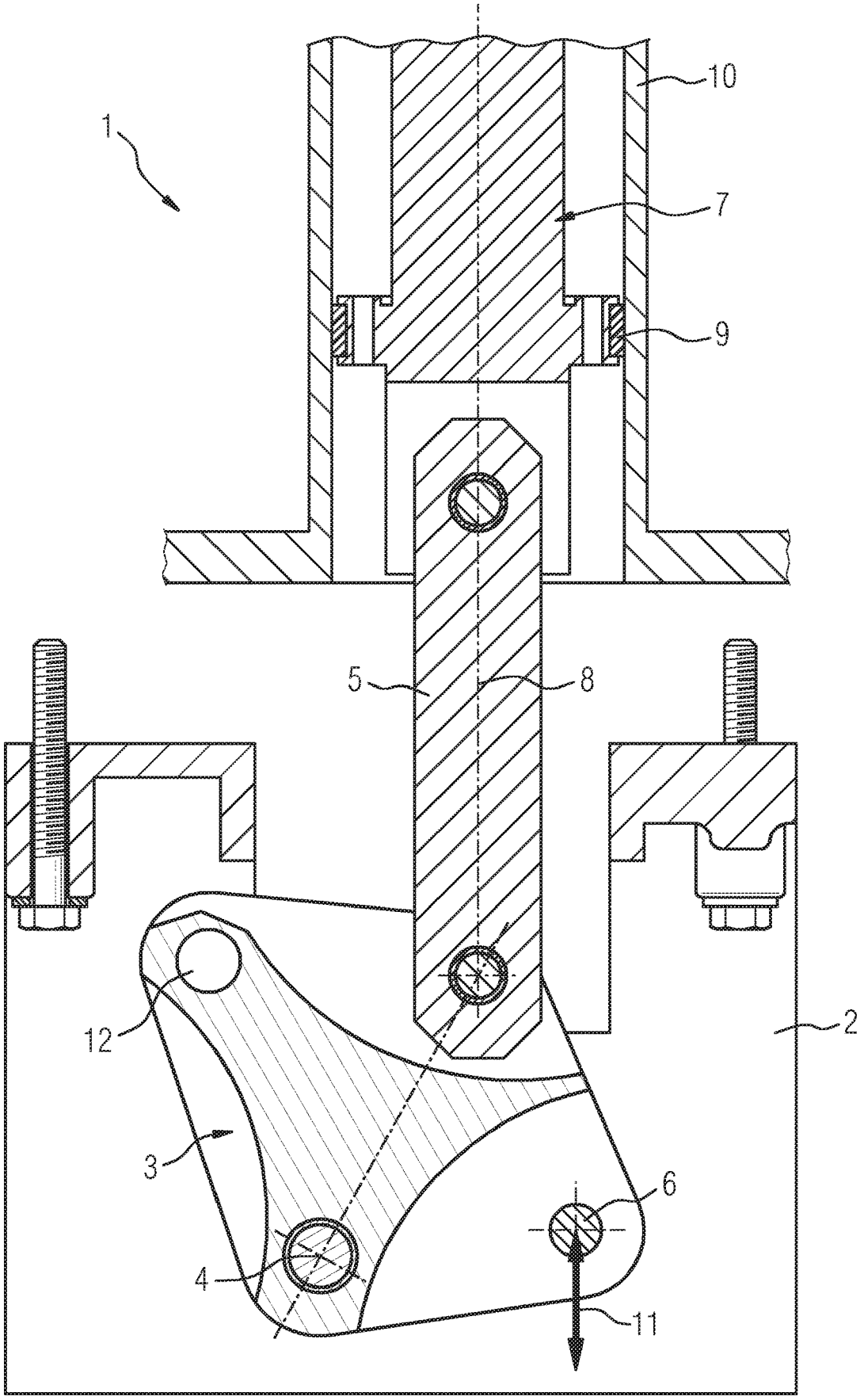
1
10
7
9
5
8
12
2
3
6
4
11

ARRANGEMENT AND METHOD FOR DRIVING A MOVABLE CONTACT OF A VACUUM INTERRUPTER IN A HIGH-VOLTAGE CIRCUIT BREAKER

BACKGROUND OF THE INVENTION

Field of the Invention

The invention relates to an arrangement and to a method for driving a movable contact of a vacuum interrupter in a high-voltage circuit breaker, comprising a switching rod as an element of a kinematic chain of the high-voltage circuit breaker, comprising a lever element which is rotatable about an axis and can be mechanically connected to a drive by means of a connecting element, and comprising a coupling element which is designed to mechanically movably couple the switching rod to the lever element.

High-voltage circuit breakers are designed for switching voltages in the range of up to 1200 kV and in the range of up to a few thousand amperes. Switching gases, such as $SF_6$ for example, which are harmful to the environment and/or contain noxious components are used in the process. Gas-tight insulation of the high-voltage circuit breakers, which insulation is stable in the long term and reliably prevents gases from escaping, is complex and increases the costs for servicing. Given the same construction and given the same maximum switching voltages or currents to be switched, switches with alternative switching gases, such as clean air for example, that is to say dry, purified air, have to be designed with larger dimensions in order to ensure reliable electrical insulation between the electrically conductive components, this increasing the costs. The use of vacuum interrupters in high-voltage circuit breakers, in conjunction with clean air as insulating gas, is an alternative to, for example, gas-insulated switches with nominal and arcing contacts comprising switching gases such as $SF_6$ for example.

The vacuum interrupters are arranged in an external insulator which is designed, for example in a pillar-like manner, with circularly encircling ribs on the outer circumference in order to increase the electrical insulation along the outer lateral surface in the direction of the longitudinal axis. The insulator is arranged upright during operation of the high-voltage circuit breaker, for example on a supporting frame or on a support with a foundation, or for example is arranged in a horizontal manner as an arm of a T-shaped high-voltage circuit breaker. One or more vacuum interrupters are arranged, for example, along the longitudinal axis of the insulator, in particular coaxially to the longitudinal axis of the insulator and mechanically fixed securely in the insulator. The high-voltage circuit breaker can comprise more than one vacuum interrupter connected in series and/or in parallel, wherein it is assumed there is one vacuum interrupter in the text which follows for reasons of simplicity.

The vacuum interrupter is arranged and connected in a mechanically stable and electrically conductive manner between at least two outer electrical connections in the interior of the insulator, wherein the electrical connections are designed, for example, in the form of connection lugs for connecting high-voltage lines, current generators and/or current consumers. The design of a vacuum interrupter for high-voltage circuit breakers is known, for example, from EP 0 102 317 A2. The vacuum interrupter comprises a housing in the form of a circular, straight cylinder which is evacuated in the interior. The housing is constructed from two identical, straight cylindrical halves composed of ceramic or ceramic parts which are joined by means of a metal cylinder or by means of a metal part with transition pieces in the center of the housing. The transition pieces are designed as shielding electrodes or a shield in the housing.

The vacuum interrupter comprises, for switching purposes, at least one electrical contact with a fixed and a movable contact piece. As an alternative, a plurality of movable contact pieces can be comprised by the at least one electrical contact, with or without one or more fixed contact pieces. It is assumed that there is one vacuum interrupter with a fixed and a movable contact piece in the text which follows for reasons of simplicity. The contact pieces are designed in plate-like form in the vacuum interrupter and are surrounded by vacuum. The contact pieces are guided to the outside in a bolt-like manner and are each electrically connected to an outer electrical connection, for example in the form of a connection lug of the high-voltage circuit breaker. The movable contact piece is guided and mounted such that it can be moved into the vacuum interrupter in a vacuum-tight manner by means of a set of folding bellows.

During switch on, the movable contact piece is moved toward the fixed contact piece until there is mechanical and electrical contact between the contact pieces. During switch off, the movable contact piece is moved away from the fixed contact piece until the electrical contact between the contact pieces is interrupted and there is a sufficient distance to avoid electrical flashovers when voltage is applied. At high voltages, for example in the region of 145 kV, large distances, in particular in the centimeter range, are required between the contact pieces. The vacuum interrupter is of long design in order to ensure sufficient distances in the interior. The straight cylindrical halves composed of ceramic or ceramic parts of the housing of the vacuum interrupter are constructed from a plurality of parts which are joined by means of metal parts with transition pieces. The transition pieces are each designed as shielding electrodes or a shield in the housing. Ceramic parts of the housing are connected, for example by soldering, by means of metal parts which are composed of copper and/or steel for example.

The kinetic energy for switching the vacuum interrupter, that is to say for moving the movable contact piece, is provided by a drive, in particular a stored-energy spring mechanism. It is assumed that there is one drive in the text which follows for reasons of simplicity, but a plurality of drives, in particular for switching multipole high-voltage circuit breakers, can also be provided. The drive energy or the drive movement is transmitted from the drive to the movable contact piece of the vacuum interrupter by means of elements of a kinematic chain. The elements of the kinematic chain comprise, for example, a switching rod which directly or indirectly transmits kinetic energy to the movable contact piece, a lever element, in particular in a transmission, which is coupled in a mechanically movable, force-transmitting manner to the drive by means of at least one connecting element for example, and a coupling element which is designed to transmit kinetic energy from the lever element to the switching rod.

During the transmission of the drive energy or the drive movement from the drive to the movable contact piece of the vacuum interrupter, the direction of the force and/or the magnitude of the force is converted depending on time, as a result of which a defined movement profile of the movable contact piece is generated from the energy which is provided by the drive. The kinetic energy which is required for reliable switching is different at various times in the switching process. For example, a so-called separating action which mechanically and electrically separates the contact pieces of an electrical contact of the vacuum interrupter from one another may be required when a vacuum interrupter is switched off.

During switch on, an arc can lead to excessive heating of the contact pieces, in particular to local melting of the contact areas of the, in particular plate-like, contact pieces, which may lead to fusing of contact areas or contact pieces during cooling. In order to separate contact pieces which have fused in this way, a high force or a large amount of kinetic energy which generates a separating action is briefly required. The separating action causes the contact areas or contact pieces to be torn apart, and thereby enables reliable switch off of the vacuum interrupter or reliable disconnection of a current path by means of the contact of the vacuum interrupter. The large amount of force or high energy during the separating action can lead to movements of the switching rod with movement components perpendicular to the switching movement or to the movement direction of the movable contact piece.

For switching purposes, a directed movement of the movable contact piece in the direction of the fixed contact piece, toward the fixed contact piece or away from the fixed contact piece, is necessary. The switching rod transmits the directed movement to the movable contact piece. To this end, the switching rod is guided, for example, in a housing in order to reliably transmit a directed movement along a movement axis. Movement components of the movements of the switching rod perpendicular to the switching movement or to the movement direction of the movable contact piece during the separating action can lead to damage to the switching rod and/or to the guide and/or to the housing, through to irreversible destruction. This can further cause increased wear of the switching rod and/or of the guide and/or of the housing. Movement components of the movements of the switching rod perpendicular to the switching movement lead to losses of kinetic energy during switching, increase the energy to be provided by the drive for switching purposes, that is to say increase costs, and can cause damage to the high-voltage circuit breaker, that is to say reduce the reliability of the high-voltage circuit breaker over the long term.

SUMMARY OF THE INVENTION

The object of the present invention is to specify an arrangement and a method for driving a movable contact of a vacuum interrupter in a high-voltage circuit breaker, which arrangement and method solve the above-described problems. A particular object is to prevent or to reduce movement components of the movements of the switching rod perpendicular to the switching movement or to the movement direction of the movable contact piece during a separating action, in particular in order to save costs, to increase the reliability of the high-voltage circuit breaker and to avoid damage to the high-voltage circuit breaker during switching.

According to the invention, the specified object is achieved by an arrangement for driving a movable contact of a vacuum interrupter in a high-voltage circuit breaker having the features as claimed, and/or by a method for driving a movable contact of a vacuum interrupter in a high-voltage circuit breaker, in particular in an above-described high-voltage circuit breaker, as claimed. Advantageous refinements of the arrangement according to the invention for driving a movable contact of a vacuum interrupter in a high-voltage circuit breaker and/or of the method for driving a movable contact of a vacuum interrupter in a high-voltage circuit breaker, in particular in an above-described high-voltage circuit breaker, are specified in the dependent claims. In this case, subjects of the main claims can be combined with one another and with features of dependent claims, and features of the dependent claims can be combined with one another.

An arrangement according to the invention for driving a movable contact of a vacuum interrupter in a high-voltage circuit breaker comprises a switching rod as an element of a kinematic chain of the high-voltage circuit breaker, a lever element which is rotatable about an axis and can be mechanically connected to a drive by means of a connecting element, and a coupling element which is designed to mechanically movably couple the switching rod to the lever element. The switching rod and the coupling element each have a longitudinal axis, which longitudinal axes are arranged according to the invention substantially on a common axis at the time at which a separating action of the vacuum interrupter takes place.

Arranging the switching rod and the coupling element with the respective longitudinal axis, at the time at which a separating action of the vacuum interrupter takes place, substantially on a common axis allows force to be transmitted to the switching rod substantially in the direction of the longitudinal axis of the switching rod during the separating action. Therefore, the maximum transmitted force which is required at the time of the separating action is transmitted along the longitudinal axis of the switching rod and movement components of the movements of the switching rod perpendicular to the switching movement or to the movement direction of the movable contact piece during the separating action are prevented or reduced. This increases the reliability of the high-voltage circuit breaker, allows damage to the high-voltage circuit breaker during switching to be avoided, and allows costs for servicing and designing the guide and the housing to be saved.

Kinetic energy which is provided by the drive can be transmitted to the switching rod and therefore to the contact pieces with minimal losses, energy losses due to friction and losses due to the movement components of the movements of the switching rod perpendicular to the switching movement are reduced or minimized, and a drive can have smaller dimensions, this saving costs. Movement vibrations and bending of the guided switching rod, which can occur due to movement components of the movements of the switching rod perpendicular to the switching movement, are suppressed and parts of the kinematic chain can be designed to have smaller dimensions. Therefore, material and costs can be saved, the mass to be moved can be reduced, and the drive can be designed to have smaller dimensions.

An angle between the longitudinal axes of the switching rod and of the coupling element can lie in the range of from five to zero degrees, in particular can be precisely zero degrees, at the time at which a separating action of the vacuum interrupter takes place. At an angle of zero degrees, the movement components of the movements of the switching rod perpendicular to the switching movement are zero, this being accompanied by the above-described advantages. Fluctuations in the angle within a range of up to five degrees are tolerable, that is to say do not lead to large energy losses and/or damage to the guide or to the housing, and substantially produce the above-described advantages. It can be assumed that there is a substantially common axis of the switching rod and of the coupling element in this angular range.

The switching rod can be guided in a housing, in particular a hollow-cylindrical housing with a circular base area, by means of a guide, in particular for a linear movement of the switching rod. A guide of this kind is simple and cost-effective, reliable and prevents tilting of the switching rod during switching.

The coupling element can be of bar-like, in particular substantially cuboidal, design. Given a thickness, in particular in the range of millimeters up to centimeters, corresponding to the material of the coupling element, for example steel, and depending on the maximum force to be transmitted during the switching movement, in particular during the separating action, reliable transmission of the movement by means of the coupling element is possible in a manner which is stable over the long term, without damage to and/or deformation of the coupling element.

The coupling element, at one end, can be fastened in a rotatable manner to the switching rod by way of a fastening element, in particular a bolt or a screw, and/or the coupling element, at an opposite end, can be fastened in a rotatable manner to the lever element by way of a fastening element, in particular a bolt or a screw. Reliable fastening respectively at the end of the coupling element, for example by means of a bolt and/or by means of a screw, allows forces of the switching movement to be transmitted at any time in the movement profile in a manner which is stable over the long term and reliable.

The switching rod can be of circular-cylindrical design, with a cuboidal end to which the coupling element can be fastened in a movable manner. A circular-cylindrical switching rod allows coaxial arrangement of a coupling element, produces a high level of mechanical stability and therefore large forces which can be transmitted along a longitudinal axis of the switching rod by means of the switching rod, and a cuboidal end, to which the coupling element can be fastened in a movable manner, allows reliable, movable, simple fastening of the coupling element to the switching rod.

The lever element can be mounted in a rotatable manner about, in particular, a central axis in a bearing block, and/or can be fastened in a movable manner to the bearing block by means of a fastening element, in particular a bolt or a screw. Bearing and fastening of the lever element in this way allows reliable spatial arrangement of the lever element, in a manner which is stable over the long term, with good transmission of force to the switching rod, for generating a defined movement profile of the movable contact piece.

The lever element can have two lever arms, wherein the connecting element to the drive can be fastened to one end of a lever arm. The axis of the lever element around which the lever element is rotatably mounted can be arranged substantially in the center of the lever element. As an alternative, the lever element can have a lever arm and/or the axis of the lever element about which the lever element is rotatably mounted can be arranged substantially at one end of the lever element. The coupling element can be fastened in a movable manner to the lever element substantially in the center of the lever element. As an alternative, the coupling element can be fastened in a movable manner to the lever element substantially at one end of the lever element. By means of the shape of the lever element and the arrangement, in particular spatially on the lever element and with defined distances, of the rotation axis, of the coupling element and of the connecting element, a movement profile, which is required when switching the high-voltage circuit breaker, can be generated from the movement provided by the drive.

The common axis of the switching rod and of the coupling element can be parallel to the direction of the drive movement of the connecting element at the time at which a separating action of the vacuum interrupter takes place. This is particularly advantageous when the drive is arranged below the arrangement according to the invention or when the drive acts vertically. As an alternative, the common axis of the switching rod and of the coupling element can be perpendicular to the direction of the drive movement of the connecting element at the time at which a separating action of the vacuum interrupter takes place. This is particularly advantageous when the drive is arranged next to the arrangement according to the invention or when the drive acts horizontally. As a result, loss-free or low-loss transmission of movement from the drive to the switching rod can be ensured, with few elements of the kinematic chain and/or without additional changes in direction and therefore elements of the kinematic chain for a change in direction of the movement, with the exception of the above-described elements of the kinematic chain.

A method according to the invention for driving a movable contact of a vacuum interrupter in a high-voltage circuit breaker, in particular by way of an above-described arrangement, comprises a connecting element being moved by means of a drive and moving a lever element which is rotatable about an axis and which transmits the mechanical kinetic energy to a switching rod by means of a coupling element, which switching rod, as an element of a kinematic chain of the high-voltage circuit breaker, transmits kinetic energy to the electrical contact of the vacuum interrupter during switching. According to the invention, the longitudinal axes of the switching rod and of the coupling element substantially form a common axis at the time at which a separating action of the vacuum interrupter takes place.

The longitudinal axes of the switching rod and of the coupling element can enclose an angle of less than 5 degrees at the time at which a separating action of the vacuum interrupter takes place.

The force perpendicular to the longitudinal axis of the switching rod on the switching rod can be equal to zero at the time at which a separating action of the vacuum interrupter takes place.

The advantages of the method according to the invention for driving a movable contact of a vacuum interrupter in a high-voltage circuit breaker, in particular in an above-described high-voltage circuit breaker, as claimed are analogous to the above-described advantages of the arrangement according to the invention for driving a movable contact of a vacuum interrupter in a high-voltage circuit breaker as claimed in claim 1, and vice versa.

An exemplary embodiment of the invention will be described in more detail below and schematically illustrated in the single FIGURE,
in which the

BRIEF DESCRIPTION OF THE DRAWING

FIGURE schematically shows a sectional view through an arrangement 1 according to the invention for driving a movable contact of a vacuum interrupter in a high-voltage circuit breaker at the time at which a separating action of the vacuum interrupter takes place.

DETAILED DESCRIPTION OF THE INVENTION

The FIGURE schematically shows a sectional view through an arrangement 1 according to the invention for driving a movable contact of a vacuum interrupter in a high-voltage circuit breaker. The FIGURE shows the arrangement 1 at the time at which a separating action of the vacuum interrupter takes place. A switching rod 7 is movably mounted in a housing 10, in a manner linearly guided by means of a guide 9 by way of one end of the switching rod 7. The switching rod 7 is designed to transmit kinetic energy from a drive of the high-voltage circuit breaker to a movable contact piece of the vacuum interrupter during switching.

During switch off, that is to say when the current path is isolated by means of the vacuum interrupter or by means of the contact of the vacuum interrupter, in particular with a movable and a fixed contact piece, the contact pieces of the vacuum interrupter are pressed against one another at the beginning. The contact pieces can be welded to one another during switch on, in particular by the action of an arc. A large amount of force is required at the beginning of the switch off process, that is to say a separating action, in order to reliably separate the contact pieces from one another. The kinetic energy or the force for a separating action and the further movement of the movable contact piece are provided by the drive and transmitted to the movable contact piece by means of elements of a kinematic chain. The movement profile, in particular the profile of the force on the movable contact piece with respect to time, is determined, among other things, by the drive and the elements of the kinematic chain. At the beginning of the switch off process, during the separating action, the force to be applied is at a maximum.

For low-loss transmission of the kinetic energy from the drive to the movable contact piece with a predetermined movement profile, the kinetic energy is transmitted from the drive, by means of a connecting element 6, to a lever element 3 which is mounted in a rotatable manner about an axis 4. The lever element 3 is mechanically connected to the switching rod 7 in a movable manner by means of a coupling element 5. The kinetic energy of the drive, for example of a stored-energy spring mechanism, is transmitted from the drive, by means of the connecting element 6, as a linear movement to the lever element 3, by a rotational movement of the lever element 3 about the axis 4 to the coupling element 5 which is fastened to the lever element 3 and which is rotatably mounted at each of its ends and, by way of one end, is fastened in a movable manner to the lever element 3, and the kinetic energy is transmitted from the coupling element 5 to the switching rod 7 which, at one end, is movably connected to one end of the coupling element 5. The movement of the switching rod 7 is linear owing to the guide 9 in the housing 10, and is transmitted to the movable contact piece of the vacuum interrupter in a linear manner, that is to say with a direction along a straight line, for switching purposes.

The housing 10 is of, for example, tubular design, in particular of hollow-cylindrical design with a circular base area and top area. The switching rod 7 is of, for example, rod-like design, in particular cylindrical design, with a flattened, in particular cuboidal, end. A guide 9, which is designed, for example, in the form of a sliding ring composed of, for example, Teflon in an annular integrally formed portion with a groove on the switching rod 7, is arranged in the housing 10 in an annular manner around the circumference of the cylindrical part of the switching rod. The guide 9 slides, in the event of a linear movement of the switching rod along the longitudinal axis of the switching rod, along the inner wall of the housing 10. The housing 10 has a longitudinal axis which is coaxial to the longitudinal axis of the switching rod 7.

The coupling element 5 is of cuboidal, elongate design, in particular with four beveled or rounded edges. The coupling element 5 is fastened, at one end, in a rotatable manner to the flattened, in particular cuboidal, end of the switching rod 7 by way of a fastening element, in particular a bolt or a screw, with one side of the cuboidal end of the switching rod 7 plane-parallel to one side of the cuboidal coupling element 5. The coupling element 5 is rotatably fastened, at the opposite end, to the lever element 3 by way of a fastening element, in particular a bolt or a screw, with a flat side of the lever element 3 plane-parallel to one side of the cuboidal coupling element 5. The longitudinal axis of the coupling element 5 is on a common axis 8 with the longitudinal axis of the switching rod 7, analogously to a coaxial arrangement of the longitudinal axes, at the time at which the separating action takes place, as is illustrated in the FIGURE.

As a result, the force or the movement is transmitted from the drive by the coupling element 5 in a linear manner along the axis 8 to the switching rod 7 at the time at which the separating action takes place, when the force is at a maximum. No transverse components to the axis 8 of the force are transmitted. A movement at the time at which the separating action takes place is performed exclusively in the direction along the axis 8, as a result of which the guide 9 is not loaded in the direction of the housing 10, an oscillating or vibrating movement of the switching rod 7 is avoided, and losses in kinetic energy due to movement components perpendicular to the axis 8 are suppressed. Therefore, a reliable switching movement, in particular without tilting of the switching rod 7, is possible in the housing 10 at the time at which the separating action takes place, with minimal expenditure of force or energy, as a result of which the drive and components of the kinematic chain can be designed to be correspondingly small, this saving costs and energy.

The lever element 3 is rotatably fixed in a mechanically stable manner to a bearing block 2 by means of a fastening means, in particular a bolt or a screw. The bearing block 2 and the housing 10 are fastened, for example screwed or welded, to a supporting frame of the high-voltage circuit breaker for example. The vacuum interrupter and the housing 10 are comprised, for example, by an insulator which can likewise be fastened to the supporting frame, for example in an upright manner as a pillar on the supporting frame, this not being illustrated in the FIGURE for reasons of simplicity.

The lever element 3 is designed, for example, as a parallelepiped with rounded edges. Grooves can be made in the body of the lever element 3, wherein one end of the coupling element 5 can be arranged in a manner pushed into a groove. As an alternative, the coupling element 5 can be arranged on and rotatably fastened to the outside of one side of the lever element 3. Bores can be made in the lever element 3 adjacent to the two opposite edges of the lever element 3, as is shown in the FIGURE, wherein the coupling element 5 is fastened by means of the fastening means and a bore. Opposite to this, the lever element 2 is fastened to and rotatably mounted on the bearing block 2 by means of the second bore and a fastening means.

A bore can be made in the lever element 3 adjacent to a further edge of the lever element 3, as is shown in the FIGURE, wherein the connecting element 6 to the drive is fastened by means of a fastening means and the bore. The three bores in the lever element 3 form a triangle in a plan view of the lever element 3, as is shown in the FIGURE. In a drive which is arranged vertically in relation to the bearing block 2 or adjacent along the axis 8, that is to say below the bearing block 2 in the FIGURE, the connecting element 6 is arranged at or rotatably fastened to the bore, in particular, of the right-hand corner of the lever element 3 in accordance with the FIGURE. The force or movement direction 11 of the connecting element 6 during a switching movement is parallel to the axis 8 on which the longitudinal axes of the switching rod 7 and of the coupling element 5 lie at the time at which the separating action takes place.

In a drive which is arranged horizontally in relation to the bearing block 2 or adjacent perpendicular to the axis 8, that is to say in particular on the left next to the bearing block 2 in the FIGURE, the connecting element 12 is arranged at or rotatably fastened to the bore of, in particular, the left-hand corner of the lever element 3 in accordance with the FIGURE. The force or movement direction of the connecting element 12 during a switching movement is perpendicular to the axis 8 on which the longitudinal axes of the switching rod 7 and of the coupling element 5 lie at the time at which the separating action takes place.

The above-described exemplary embodiments can be combined with one another and/or can be combined with the prior art. Therefore, for example, all elements or parts of the arrangement 1 in the FIGURE can be composed of metal, in particular steel, cast iron and/or copper. The guide can have a sliding ring composed of, for example, Teflon, plastic and/or rubber. The housing 10 can be comprised by an insulator in which the vacuum interrupter is arranged, in each case sealed off in a gas-tight manner in the region of the switching rod 7 by means of a set of bellows. The insulator can, for example, be composed of silicone, ceramic and/or a composite material. In this case, the housing 10 can be arranged in the insulator, for example as a metal pipe. As an alternative, the housing 10 can be part of the insulator. The end of the switching rod 7 can be designed as a cuboid or in a circular-cylindrical manner, wherein a groove can be made in the end, the coupling element being pushed into said groove in a movable manner and being fastened in a rotatable manner to the switching rod 7. The lever element 3 can be designed, for example, as a parallelepiped or as a prism with a triangular base area, in particular with rounded edges.

LIST OF REFERENCE SIGNS

1 Arrangement for driving a movable contact of a vacuum interrupter in a high-voltage circuit breaker
2 Bearing block
3 Lever element
4 Axis on the lever element
5 Coupling element for the switching rod
6 Connecting element for the drive parallel to the coaxial axis
7 Switching rod
8 Coaxial axis of the coupling element and of the switching rod at the time at which a separating action of the vacuum interrupter takes place
9 Guide of the switching rod
10 Housing
11 Drive movement of the connecting element in a connecting element parallel to the coaxial axis
12 Connecting element for the drive perpendicular to the coaxial axis

The invention claimed is:

1. An arrangement for driving a movable contact of a vacuum interrupter in a high-voltage circuit breaker, the arrangement comprising:

a switching rod forming an element of a kinematic chain of the high-voltage circuit breaker, said switching rod having a longitudinal axis;

a lever element rotatably mounted about an axis and configured to be mechanically connected to a drive by way of a connecting element;

a coupling element configured to mechanically movably connect said switching rod with said lever element, said coupling element having a longitudinal axis;

said switching rod having a circular-cylindrical shape, with a cuboidal end movably fastened to said coupling element;

said longitudinal axis of said switching rod and said longitudinal axis of said coupling element being oriented substantially on a common axis at a moment in time at which a separating action of the vacuum interrupter takes place.

2. The arrangement according to claim 1, wherein an angle between the longitudinal axis of said switching rod and the longitudinal axis of said coupling element is precisely zero degrees at the moment in time when the separating action takes place.

3. The arrangement according to claim 1, further comprising a housing and a guide for guiding a movement of said switching rod in said housing.

4. The arrangement according to claim 3, wherein said housing is a hollow-cylindrical housing with a circular base area, and said guide is configured to guide said switching rod along a linear movement path.

5. The arrangement according to claim 1, wherein said coupling element has a cuboidal bar shape.

6. The arrangement according to claim 1, wherein said coupling element has a first end rotatably fastened to said switching rod by way of a fastening element and an opposite end rotatably fastened to said lever element by way of a fastening element.

7. The arrangement according to claim 6, wherein said fastening element connecting said first end and said opposite end of said coupling element is a bolt or a screw.

8. The arrangement according to claim 1, wherein said lever element is rotatably mounted about a central axis in a bearing block, and/or said lever element is movably fastened to said bearing block by way of a fastening element.

9. The arrangement according to claim 8, wherein said fastening element is a bolt or a screw.

10. The arrangement according to claim 1, wherein said lever element has two lever arms, and said connecting element for connecting to the drive is fastened to one end of one of said two lever arms.

11. The arrangement according to claim 1, wherein the axis about which said lever element is rotatably mounted is arranged in a center of said lever element, and/or said coupling element is movably fastened to said lever element in the center of said lever element.

12. The arrangement according to claim 1, wherein the common axis of said switching rod and of said coupling element is parallel to a direction of a drive movement of said connecting element at the time at which the separating action of the vacuum interrupter takes place.

13. The arrangement according to claim 1, wherein the common axis of said switching rod and of said coupling element is perpendicular to a direction of a drive movement of said connecting element at the time at which the separating action of the vacuum interrupter takes place.

14. A method for driving a movable contact of a vacuum interrupter in a high-voltage circuit breaker, the method comprising:

providing a switching rod with a circular-cylindrical shape, and a cuboidal end movably fastened to a coupling element;

moving a connecting element by a drive and thereby moving a lever element which is rotatable about an axis and which thereby transmits mechanical kinetic energy to the switching rod by way of the coupling element;

transmitting with the switching rod, which forms a member of a kinematic chain of the high-voltage circuit breaker, kinetic energy to an electrical contact of the vacuum interrupter during switching; and aligning a longitudinal axis of the switching rod and a longitudinal axis of the coupling element to substantially form a common axis at a time at which a separating action of the vacuum interrupter takes place.

15. The method according to claim 14, which comprises providing the arrangement according to claim 1, and carrying out the method with the arrangement.

16. The method according to claim 14, wherein the longitudinal axes of the switching rod and of the coupling element enclose an angle of less than five degrees at the time at which the separating action of the vacuum interrupter takes place.

17. The method according to claim 14, wherein a force perpendicular to the longitudinal axis of the switching rod on the switching rod is equal to zero at the time at which the separating action of the vacuum interrupter takes place.

* * * * *